US008032366B2

(12) United States Patent
Mapes-Riordan et al.

(10) Patent No.: US 8,032,366 B2
(45) Date of Patent: Oct. 4, 2011

(54) METHOD AND APPARATUS FOR LOW BIT RATE SPEECH CODING DETECTION

(75) Inventors: Daniel Mapes-Riordan, Evanston, IL (US); Steve R. Page, Naperville, IL (US)

(73) Assignee: Tellabs Operations, Inc., Naperville, IL (US)

( * ) Notice: Subject to any disclaimer, the term of this patent is extended or adjusted under 35 U.S.C. 154(b) by 810 days.

(21) Appl. No.: 12/152,841

(22) Filed: May 16, 2008

(65) Prior Publication Data

US 2009/0287480 A1 Nov. 19, 2009

(51) Int. Cl.
*G10L 21/02* (2006.01)
*G10L 19/00* (2006.01)

(52) U.S. Cl. ..... 704/228; 704/206; 704/213

(58) Field of Classification Search ..... None
See application file for complete search history.

(56) References Cited

OTHER PUBLICATIONS

Juin-Hwey Chen and Allen Gersho, "Adaptaive Postfiltering for Quality Enhancement of Coded Speech", IEEE Trans. Speech and Audio Processing, vol. 3, p. 59-70, Jan. 1995.*

R.C. de Lamare and A. Alcaim, "Strategies to improve the performance of very low bit rate speech coders and application to a variable rate 1.2 kb/s codec", IEE Proceedings—Vision, Image and Signal Processing, vol. 152, 74-86, Feb. 28, 2005.*

* cited by examiner

*Primary Examiner* — Talivaldis Ivars Smits
(74) *Attorney, Agent, or Firm* — Hamilton, Brook, Smith & Reynolds, P.C.

(57) ABSTRACT

To increase channel capacity, mobile phone carriers have deployed speech coders, such as Advanced MultiBand Excitation coding (AMBE), in networks to reduce the bit rate of each call. One undesired consequence of employing such speech coders is that the voice quality can be much worse as compared to higher bit-rate speech coders. A method or corresponding apparatus in an example embodiment of the present invention performs voice quality enhancement transparently within a network by detecting use of a coder applying rate reduction to a speech signal and known to have an adverse effect on a coded speech signal. Upon detection of the use of such coder, the coded speech signal is corrected based on components introduced into the coded speech signal due to the rate reduction. As a result of applying the voice quality enhancement, adverse effects of speech coders can be reduced, while maintaining high quality voice signals.

47 Claims, 5 Drawing Sheets

METHOD AND APPARATUS FOR LOW BIT RATE SPEECH CODING DETECTION

BACKGROUND OF THE INVENTION

In an effort to increase channel capacity, mobile phone carriers have deployed speech coders, such as Advanced MultiBand Excitation (AMBE) coding, in the network to reduce the bit rate of each call. One undesired consequence of employing such speech coders is that the voice quality can be much worse as compared to higher bit-rate speech coders. In particular, AMBE speech coding has shown to produce a spectral imbalance overemphasizing high frequency spectral content. This imbalance produces a "thinness" of the lower frequency speech content and excessive high-frequency sibilance sounds. The network contains Voice Quality Enhancement equipment which can improve these effects, but unfortunately, the telephone networks do not employ any type of signaling to indicate the form of speech coding employed.

SUMMARY OF THE INVENTION

A method or corresponding apparatus in an example embodiment of the present invention performs voice quality enhancement by detecting use of a coder, that applies rate reduction to a speech signal, and is known to have an adverse effect on a coded speech signal. Upon detection of the use of such coder, the coded speech signal is corrected as a function of components introduced into the coded speech signal due to the rate reduction.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

An example embodiment of the present invention relates to Media Quality Enhancement (MQE) applications, such as Voice Quality Enhancement (VQE), in telephony networks.

An example embodiment of the invention describes a method and corresponding apparatus for detecting a presence of low bit-rate coding, such as Advanced MultiBand Excitation (AMBE) coding and other MultiBand Excitation (MBE) coding, using the speech signal itself. Once the presence of low bit-rate coding is detected, corrective measures are employed to improve the voice quality of the source speech.

One embodiment of this invention employs AMBE as the specific low-bit rate speech coding to be detected and corrected. Under other possible embodiments of the invention, use of other low-bit rate coders in a media transport or other network may be detected and corrected.

Figure 1:
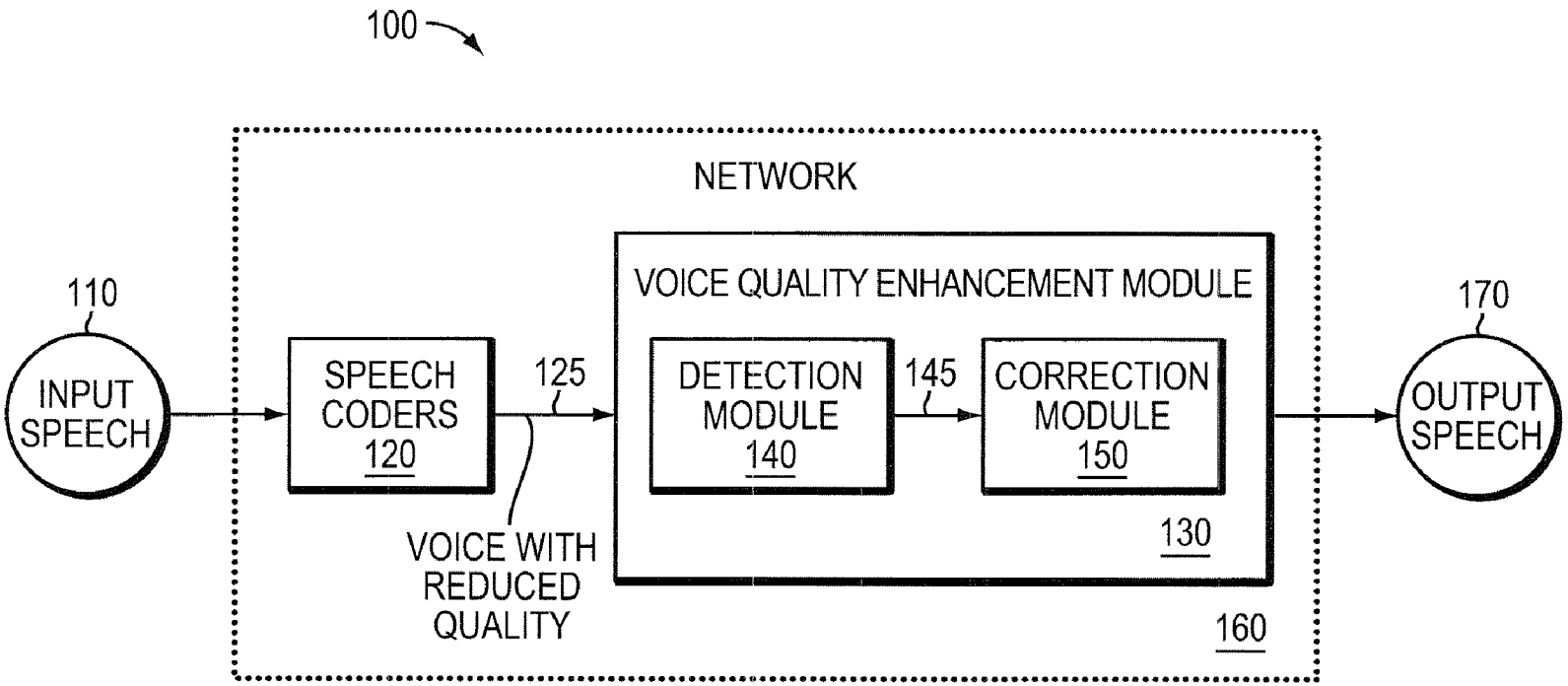
FIG. 1 is a network diagram of a telephone network that employs a Voice Quality Enhancement (VQE) module according to an example embodiment of the present invention.

FIG. 1 is a network diagram 100 of a telephone network that employs a Voice Quality Enhancement (VQE) module 130 according to an example embodiment of the present invention. The input speech signal 110 enters a network 160 that deploys speech coders 120, such as Advanced MultiBand Excitation (AMBE) coding, to reduce the bit rate of each call. The resulting voice signal with reduced quality 125 subsequently enters the voice quality enhancement module 130.

An example system for improving low bit-rate speech coding includes detection 140 and correction 150 modules. The detection module 140 is responsible for detecting the presence of low bit rate coding, such as AMBE or other MBE coding, using the speech signal itself. Once the presence of low bit-rate coding is detected, corrective measures are employed to improve the voice quality of the source speech.

The output of the detection module is a control signal 145 that is sent to the correction module 150. The correction module 150 then employs the detection input 145 and applies corrective measures to improve the quality of the speech signal 125. The voice quality enhancement module 130 subsequently outputs the corrected speech 170.

The voice quality enhancement module 130 of this example embodiment performs very well on a pilot set of AMBE coded and non-AMBE coded speech samples. The detection time for detecting the presence of low bit rate coding may vary as a direct relation with a relative amount of degradation present in the input speech signal 110. A tradeoff may exist between a speed of detection time and a number of false detections. Thus, false detections may be tolerated as the variable gain mapping may produce relatively small mixing of the correction signal if the input speech signal is deemed to be only mildly degraded.

The voice quality enhancement module 130 of this example embodiment may also estimate the relative amount of speech coding that has been applied to a speech sample.

In accordance with the foregoing, a method or corresponding apparatus in an example embodiment of the present invention performs voice quality enhancement by detecting the use of a coder applying rate reduction to a speech signal, known to have an adverse effect on a coded speech signal. Upon detection of the use of such coder, the coded speech signal is corrected as a function of components introduced into the coded speech signal due to the rate reduction.

Another example embodiment of the present invention includes a computer program product including a computer readable medium having computer readable code stored thereon, which, when executed by a processor, causes the processor to detect use of a coder applying rate reduction to a speech signal, the coder known to have an adverse effect on a coded speech signal. Upon detection of the use of such coder, the coded speech signal is corrected as a function of components introduced into the coded speech signal due to the rate reduction.

In the view of the foregoing, the following description illustrates example embodiments and features that may be incorporated into a system for voice quality enhancement, where the term "system" may be interpreted as a system, subsystem, apparatus, device, method or any combination thereof.

The system may detect the use of a coder such as an Advanced Multiband Excitation Coder. In order to detect the use of the coder the system may detect noisy components in portions of spectrum in which periodic waveforms are present. Alternatively, the system may detect the use of the coder by detecting noise in low frequency bands. In order to detect noise in low frequency bands the system may detect portions of spectrum that are dominated by periodic frequencies. Alternatively, the system may detect zero-crossings in a low-pass filtered version of the speech signal to detect noise in low frequency bands. The system may generate a signal in response to detecting the zero-crossings. The system may smooth the signal generated in response to detecting the zero-crossings to reduce variability. The system may employ dual-slope smoothing of the signal generated in response to detecting the zero-crossings to emphasize periodic frequencies. The system may smooth the signal generated in response to detecting the zero-crossings to generate a periodic activity detection signal. The system may measure periodicity in the speech signal over time and generate the periodic activity detection signal based on the periodicity. The system may compare the periodic activity detection signal to a threshold, measure number of threshold crossings of the periodic activity detection signal, and generate a periodic activity detection rate signal as a function of the number of threshold crossings. The system may compare the periodic activity detection rate signal to a criterion threshold. The system may correct the coded speech signal in an event the periodic activity detection rate signal exceeds the criterion threshold.

The system may correct the coded speech signal by applying a bass boost filter and a sibilance filter to the speech signal. The sibilance filter may include a low-pass filter and a sibilance detector. In order to correct the coded speech signal, the system may dynamically mix output of the bass boost filter and output of the sibilance filter as a function of amount of sibilance in the speech signal. The system may dynamically mix the speech signal with output from the sibilance filter as a function of the degree of degradation resulting from the coder applying a rate reduction. The system may dynamically mix the speech signal with output from the sibilance filter as a function of a smoothed version of the periodic activity detection signal. The system may map the smoothed version of the periodic activity detection signal to one at periodic activity detection signal threshold values. The system may map the smoothed periodic activity detection signal to a minimum value at lower than periodic activity detection signal threshold values.

The system may ensure zero net gain using an automatic gain control.

Figure 2:
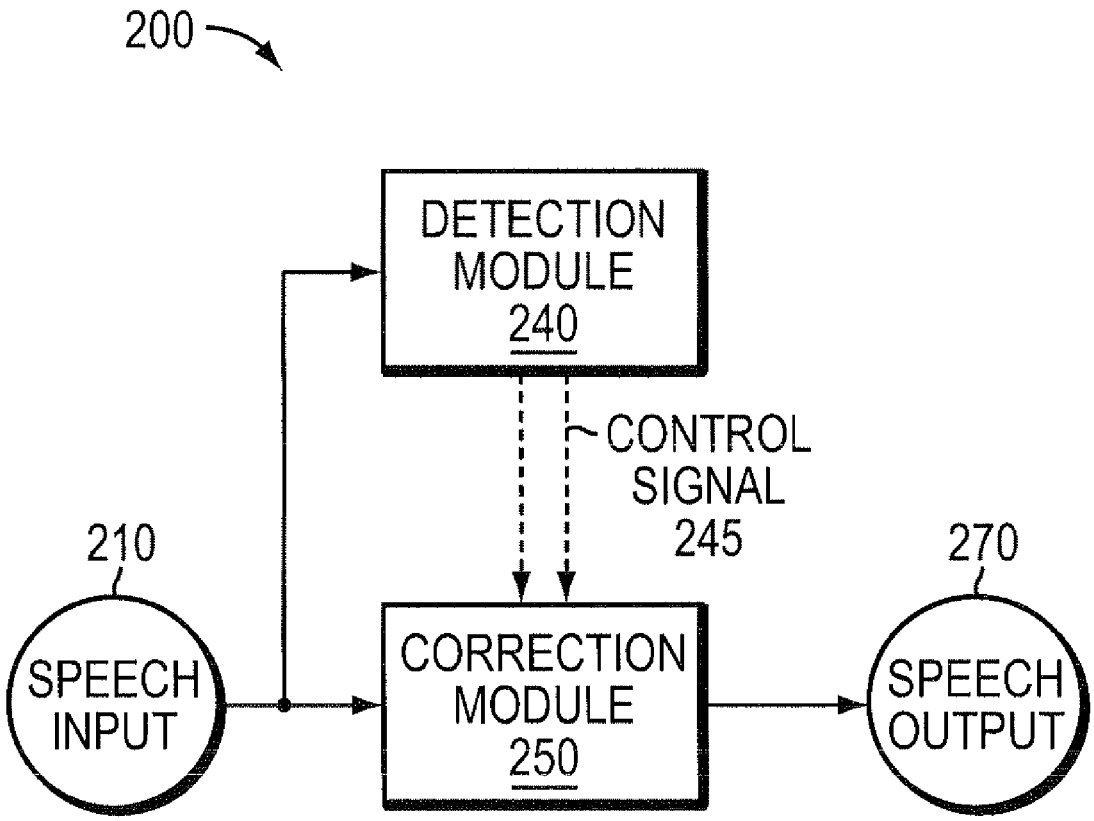
FIG. 2 is a flow chart illustration of an example system for improving low bit-rate speech coding.

FIG. 2 is a flow chart illustration of an example system 200 for improving low bit-rate speech coding, such as AMBE or other MBE coding. In this example embodiment, the input speech signal 210 is applied to both the detection module 240 and the correction module 250. The output of the detection module 240 is a control signal 245 that is sent to the correction module 250. The correction module employs the detection input 245 to correct the speech input 210 as needed. The correction module then outputs the corrected speech 270.

Figure 3:
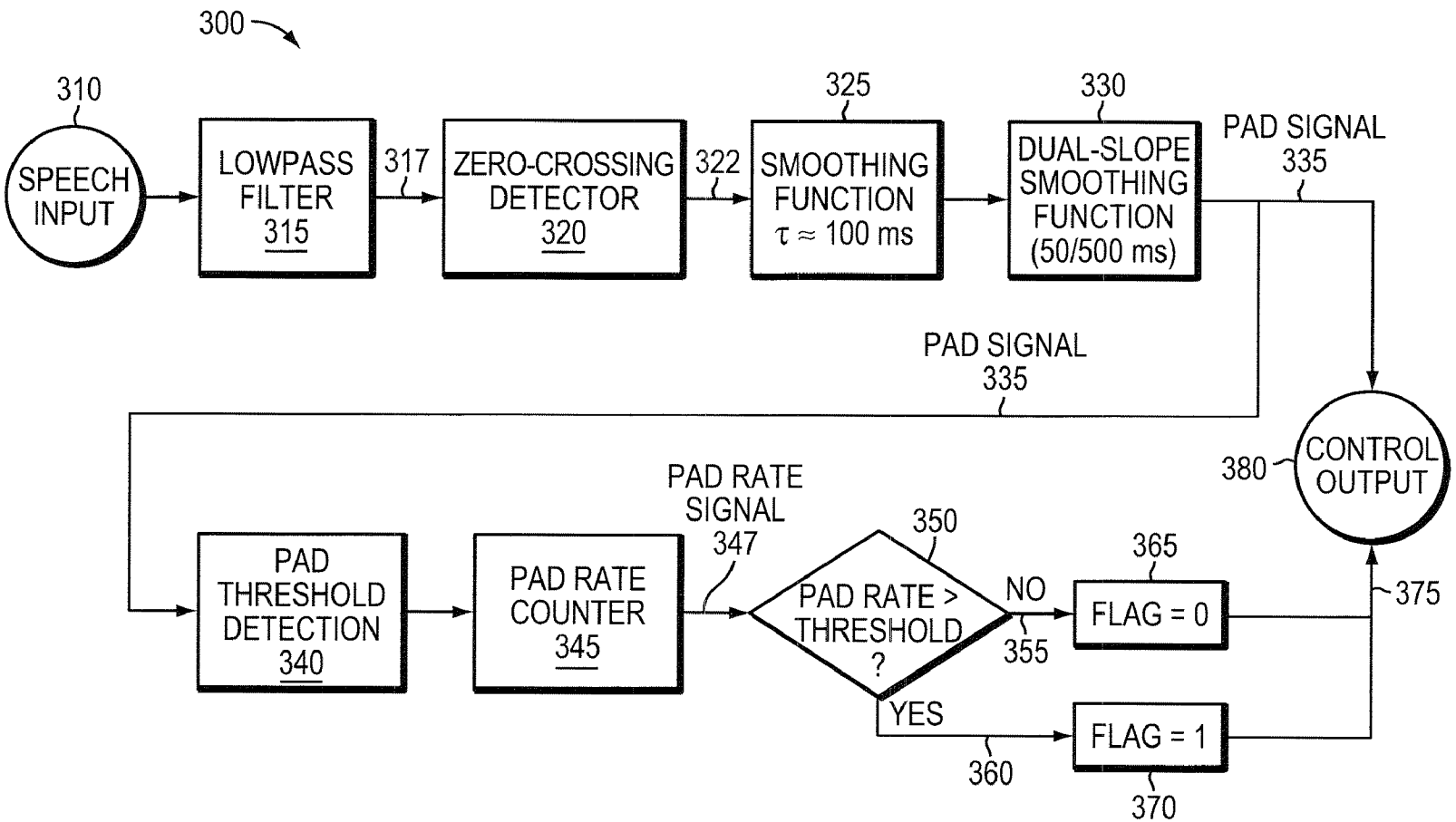
FIG. 3 is a flow chart illustrating operation of an example detection module responsible for detecting adverse effects of speech coders.

FIG. 3 is a flow chart 300 illustrating example operation of the detection module responsible for detecting the adverse effects of speech coders. The detection module operates based on the observation that a coder introduces noise into the low frequency bands. In this example embodiment, an AMBE coder is used as an example coder introducing adverse effects to the speech signal. The detection module operates similarly in the presence of coders employing other coding procedures.

The amount of noise in the low-frequency bands of AMBE coders increases with the amount of noise mixed in with the speech input prior to coding. This may be caused by the AMBE coder leaking high frequency noise and sibilance energy into the low frequency bands. The leakage of noisy energy into low frequency bands may cause the AMBE coder to misidentify voiced band(s) as unvoiced and thus incorrectly synthesize the voiced band(s).

The detector module of this example embodiment may detect the amount of noise in the low-frequency bands. The example embodiment applies a low pass filter 315 to the input speech signal 310 and subsequently detects the amount of noise in the low-frequency bands by detecting the zero-crossings 320 in the low pass-filtered version 317 of the speech input 310. Cutoff frequencies of the low pass filter 315 in the range of 1500 Hz have been shown to produce good detection performance for speech processing. The low frequencies of speech waveforms are dominated by the periodic fundamental ($f_0$) and formant frequencies produced by speech utterances. Speech coders can exploit this fact to reduce the overall bit-rate by coding periodic content in low frequency bands in a simpler form.

The zero-crossing detector 320 is responsible for measuring the relative periodicity of the input waveform. The amount of zero-crossings 320 is relatively low in periodic signals as compared to noisy signals. Thus, since the low frequency content of clean speech is very periodic, it produces a relatively low number of zero-crossings. In contrast, low bit rate encoded-speech has a relatively high number of zero-crossings.

The output 322 of the zero-crossing detector 320 can vary widely depending on the speech signal input 310. In this example embodiment, following the zero-crossing detector 320, a smoothing function 325 is applied to reduce the variability in the signal output 322 of the zero-crossing detector 320.

Subsequently, a dual-slope smoothing function 330 is employed to emphasize periodic detection (i.e., low zero-crossing rates) by having a faster falling signal time constant than rising signal time constant (e.g., 50 ms vs. 500 ms).

The output of the dual-slope smoothing function 330 is a periodic activity detection (pad) signal 335. This signal 335 is a measure of the periodicity in the low-frequency speech input 310 as a function of time.

Pad signals resulting from high bit rate speech coder input have a relatively low mean and variability. In contrast, coders using low bit-rate speech coding, such as AMBE or other MBE coding procedures, produce a pad signal with a relatively higher mean and variability.

This difference is exploited in a pad threshold detection module 340 by comparing the pad signal 335 with a threshold value. A pad rate counter 345 keeps a running count of the number of times the pad signal 335 crosses this threshold. The amount of pad signal threshold crossings versus time is defined as the pad rate signal 347. This signal 347 is compared 350 with a criterion threshold to determine the presence of input signals effected by low bit-rate speech coders. If the pad rate is smaller than the threshold value 355, the value of a detection flag is set to zero 365. Alternatively, if the pad rate is larger than the threshold value 360, the value of the detection flag is set to one 370.

The control output 380 of the detector module of this example embodiment includes two outputs: the detection flag 375, which is used to enable correction, and the pad signal 335, which is used to throttle the correction when correction is applied.

Figure 4:
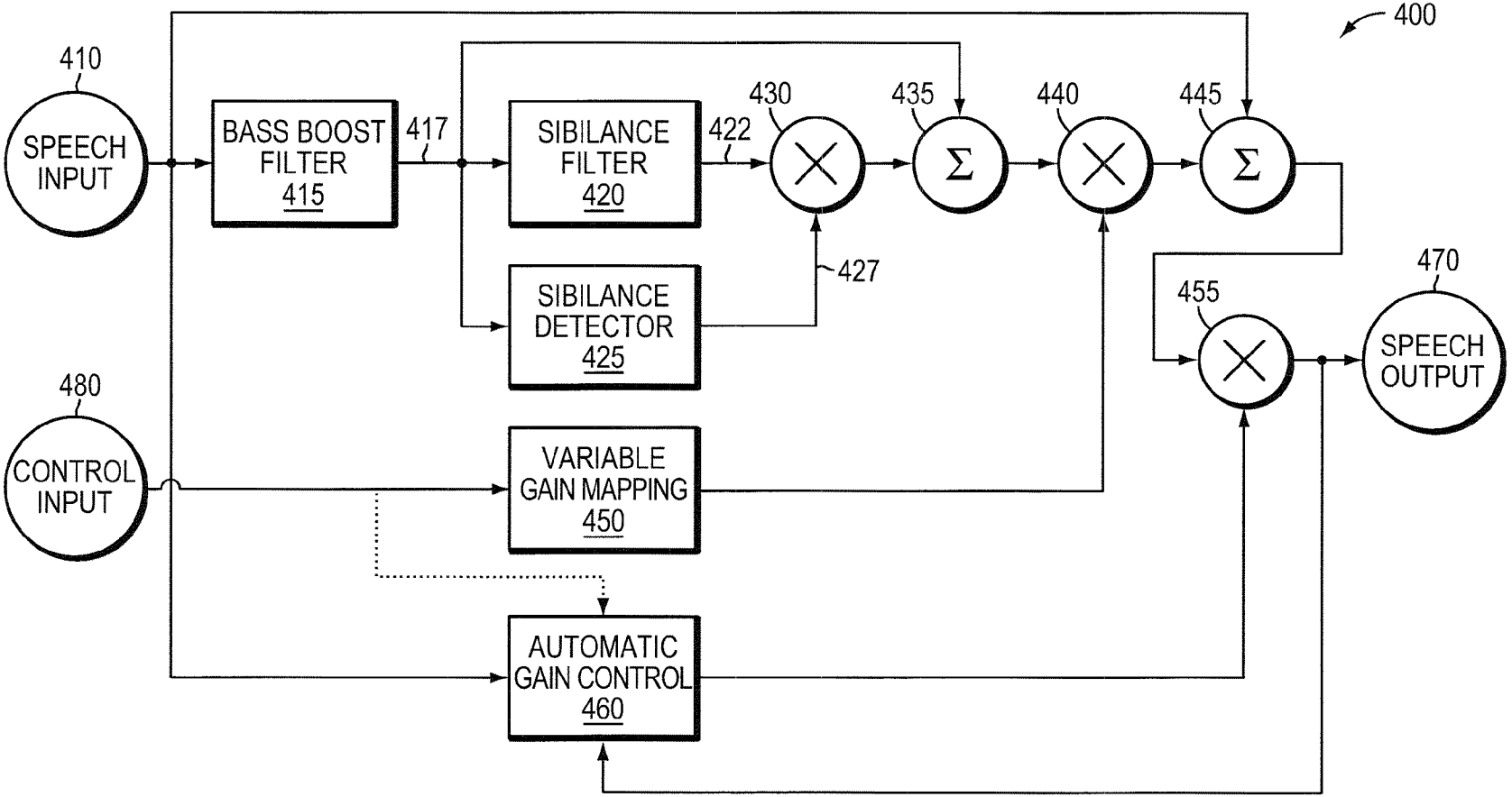
FIG. 4 is a flow chart illustrating operation of an example correction module responsible for correcting adverse effects of speech coders.

FIG. 4 is a flow chart 400 illustrating example operation of the correction module responsible for correcting adverse effects of certain speech coders.

The example embodiment may vary the amount of correction applied to the input speech signal 410 based on the knowledge that the amount of noise in the low-frequency bands in AMBE or other low rate coding increases relative to the amount of noise mixed in with the speech input prior to coding.

The input speech signal 410 initially enters a bass boost filter 415. The bass boost filter 415 at bass frequencies (i.e., low frequencies) acts to accentuate the low frequencies relative to high frequencies. A sibilance filter 420 is then applied to the output of the bass boost filter 417. The sibilance filter 420 is a dynamic filter that includes a low pass filter with a cutoff frequency of approximately 2.5 kHz. The sibilance detector 425 dynamically combines the sibilance filter output 427 with the bass boost filter output 417 depending on the amount of sibilance in the input speech signal 410. In a similar manner, the sibilance filter output 422 (i.e., the correction signal) is dynamically combined with the speech input 410. The amount of mixing depends on an estimate of the degree of AMBE (or other low bit rate) coder degradation present in the speech input 410. If the detection flag 375 is set to zero, the example embodiment assumes that no low bit rate coder degradation is present and the input speech 410 is passed directly to the speech output 470 without combining any correction signal 422. If the detection flag 375 is set (i.e., the value of the flag is set to one), the amount of correction signal 422 combined is based on a further smoothed version of the pad signal 335 that is mapped between a value of one for pad signals 335 at the pad threshold (i.e., no correction signal mixed in) to a minimum value (e.g., 0.5, maximum correction signal mixed in) for pad signals 335 at a lower threshold. The sibilance detector 425 uses zero crossings in the high frequency band above 2 kHz to create its gain output.

The example embodiment may also employ an Automatic Gain Control (AGC) module 460. The automatic gain control module 460 is a simple, first-order, feedback loop that adjusts the gain to drive the full-band output power to equal the full-band input power. The automatic gain control module 460 compensates for the differential gain of the bass boost filter and the dynamic sibilance filter.

Figure 5:
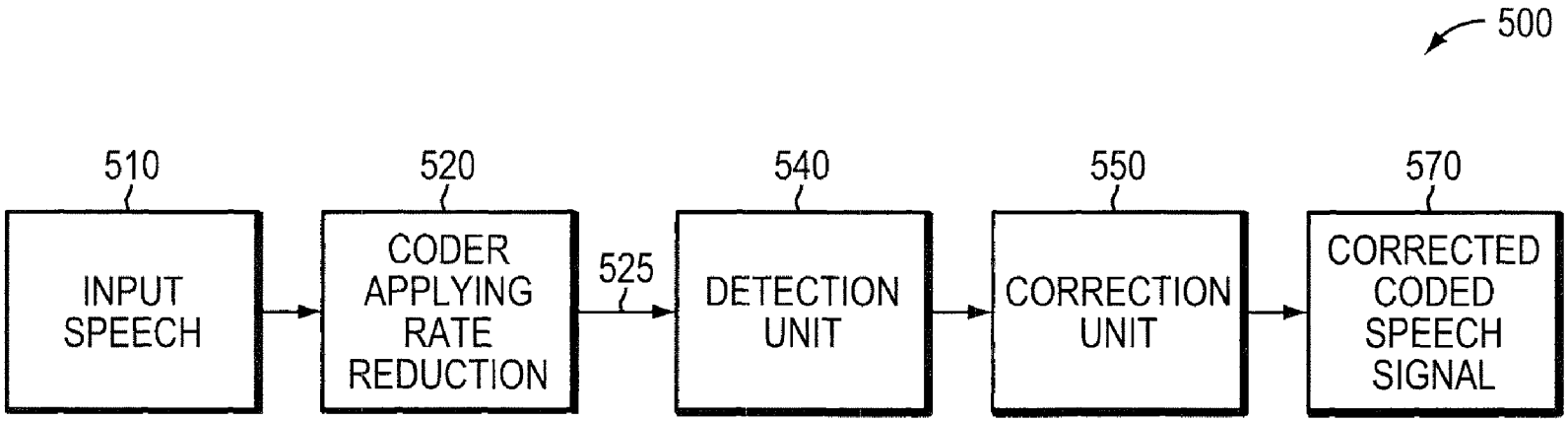
FIG. 5 is a high level flow diagram of an example embodiment of the present invention.

FIG. 5 is a high level flow diagram of an example embodiment of the present invention. In this example embodiment, the input speech 510 is degraded by a coder 520 that is known to have an adverse effect on a coded speech signal 510. The resulting degraded signal 525 enters a detection unit 540 that detects the use of the coder 520 applying rate reduction to the input speech 510. If the detection unit 540 determines that the signal has in fact been degraded by the use of the coder 520, the correction unit 550 of this example embodiment corrects the coded speech signal 510 as a function of components introduced into the coded speech signal 510 due to the rate reduction. The example embodiment subsequently outputs the resulting corrected coded speech signal 570 with enhanced voice quality.

It should be understood that procedures, such as those illustrated by flow diagram or block diagram herein or otherwise described herein, may be implemented in the form of hardware, firmware, or software. If implemented in software, the software may be implemented in any software language consistent with the teachings herein and may be stored on any computer readable medium known or later developed in the art. The software, typically, in form of instructions, can be coded and executed by a processor in a manner understood in the art.

While this invention has been particularly shown and described with references to example embodiments thereof, it will be understood by those skilled in the art that various changes in form and details may be made therein without departing from the scope of the invention encompassed by the appended claims.

What is claimed is:

1. A method for performing voice quality enhancement comprising:

detecting use of a coder applying rate reduction to a speech signal, the coder known to have an adverse effect on a coded speech signal; and correcting the coded speech signal as a function of components introduced into the coded speech signal due to the rate reduction.

2. The method of claim 1 wherein the coder is an Advanced Multiband Excitation Coder and detecting the use of the coder includes detecting the rate reductions of the speech signal.

3. The method of claim 1 wherein detecting the use of the coder includes detecting noisy components in portions of spectrum in which periodic waveforms are present.

4. The method of claim 1 wherein detecting the use of the coder includes detecting noise in low frequency bands.

5. The method of claim 4 wherein detecting noise in low frequency bands includes detecting portions of spectrum dominated by periodic frequencies.

6. The method of claim 4 wherein detecting noise in low frequency bands includes detecting zero-crossings in a low-pass filtered version of the speech signal.

7. The method of claim 6 further including detecting the zero-crossings to detect a relative periodicity of the speech signal.

8. The method of claim 6 further including generating a signal in response to detecting the zero-crossings.

9. The method of claim 8 further including smoothing the signal to reduce variability.

10. The method of claim 8 further including dual-slope smoothing the signal to emphasize periodic frequencies.

11. The method of claim 8 further including smoothing the signal to generate a periodic activity detection signal.

12. The method of claim 11 further including measuring periodicity in the speech signal over time and generating the periodic activity detection signal based on the periodicity.

13. The method of claim 11 further including comparing the periodic activity detection signal to a threshold, measuring number of threshold crossings of the periodic activity detection signal, and generating a periodic activity detection rate signal as a function of the number of threshold crossings.

14. The method of claim 13 further including comparing the periodic activity detection rate signal to a criterion threshold and in an event the periodic activity detection rate exceeds the criterion threshold reporting the use of the coder applying rate reduction to the speech signal.

15. The method of claim 1 wherein correcting the coded speech signal includes correcting the coded speech signal in an event the periodic activity detection rate signal exceeds the criterion threshold.

16. The method of claim 1 wherein correcting the coded speech signal includes applying a bass boost filter and a sibilance filter to the speech signal.

17. The method of claim 16 wherein applying the sibilance filter includes applying a low-pass filter and a sibilance detector.

18. The method of claim 16 wherein correcting the coded speech signal includes dynamically mixing output of the bass boost filter and output of the sibilance filter as a function of amount of sibilance in the speech signal.

19. The method of claim 16 further including dynamically mixing the speech signal with output from the sibilance filter as a function of the degree of degradation resulting from the coder applying a rate reduction.

20. The method of claim 16 further including dynamically mixing the speech signal with output from the sibilance filter as a function of a smoothed version of the periodic activity detection signal.

21. The method of claim 20 further including mapping the smoothed version of the periodic activity detection signal to one at periodic activity detection signal threshold values.

22. The method of claim 20 further including mapping the smoothed periodic activity detection signal to a minimum value at lower than periodic activity detection signal threshold values.

23. The method of claim 1 further including ensuring zero net gain using an automatic gain control.

24. An apparatus for performing voice quality enhancement comprising:

a detection module to detect use of a coder applying rate reduction to a speech signal, the coder known to have an adverse effect on a coded speech signal; and a correction module to correct the coded speech signal as a function of components introduced into the coded speech signal due to the rate reduction.

25. The apparatus of claim 24 wherein the coder is an Advanced Multiband Excitation Coder and the detection module is arranged to detect the use of the coder as a function of detecting the rate reductions of the speech signal.

26. The apparatus of claim 24 wherein the detection unit is arranged to detect the use of the coder as a function of detection of noisy components in portions of spectrum in which periodic waveforms are present.

27. The apparatus of claim 24 wherein the detection unit is arranged to detect the use of the coder as a function of detection of noise in low frequency bands.

28. The apparatus of claim 27 wherein detection of noise in low frequency bands includes detection of portions of spectrum dominated by periodic frequencies.

29. The apparatus of claim 27 wherein detection of noise in low frequency bands includes detection of zero-crossings in a low-pass filtered version of the speech signal.

30. The apparatus of claim 29 further including detection of zero-crossings to detect a relative periodicity of the speech signal.

31. The apparatus of claim 29 further including a generation unit arranged to generate a signal in response to detection of the zero-crossings.

32. The apparatus of claim 31 further including a smoothing unit arranged to smooth the signal to reduce variability.

33. The apparatus of claim 32 further including a smoothing unit arranged to dual-slope smooth the signal to emphasize periodic frequencies.

34. The apparatus of claim 32 further including a smoothing unit arranged to smooth the signal to generate a periodic activity detection signal.

35. The apparatus of claim 34 further including a measurement unit arranged to measure periodicity in the speech signal over time and generate the periodic activity detection signal based on the periodicity.

36. The apparatus of claim 34 further including a comparison unit arranged to compare the periodic activity detection signal to a threshold, measure number of threshold crossings of the periodic activity detection signal, and generate a periodic activity detection rate signal as a function of the number of threshold crossings.

37. The apparatus of claim 36 further including a comparison unit arranged to compare the periodic activity detection rate signal to a criterion threshold and in an event the periodic activity detection rate exceeds the criterion threshold report the use of the coder applying rate reduction to the speech signal.

38. The apparatus of claim 24 wherein the correction unit is arranged to correct the coded speech signal in an event the periodic activity detection rate signal exceeds the criterion threshold.

39. The apparatus of claim 24 wherein the correction unit is arranged to correct the coded speech signal based on applying a bass boost filter and a sibilance filter to the speech signal.

40. The apparatus of claim 39 wherein applying the sibilance filter includes applying a low-pass filter and a sibilance detector.

41. The apparatus of claim 39 wherein the correction unit is arranged to correct the coded speech signal based on dynamically mixing output of the bass boost filter and output of the sibilance filter as a function of amount of sibilance in the speech signal.

42. The apparatus of claim 39 further including a mixing unit arranged to dynamically mix the speech signal with output from the sibilance filter as a function of the degree of degradation resulting from the coder applying a rate reduction.

43. The apparatus of claim 39 further including a mixing unit arranged to dynamically mix the speech signal with output from the sibilance filter as a function of a smoothed version of the periodic activity detection signal.

44. The apparatus of claim 43 further including a mapping unit arranged to map the smoothed version of the periodic activity detection signal to one at periodic activity detection signal threshold values.

45. The apparatus of claim 43 further including a mapping unit arranged to map the smoothed periodic activity detection signal to a minimum value at lower than periodic activity detection signal threshold values.

46. The apparatus of claim 24 further including a module arranged to ensure zero net gain using an automatic gain control.

47. A computer program product comprising a computer readable medium having computer readable code stored thereon, which, when executed by a processor, causes the processor to:

detect use of a coder applying rate reduction to a speech signal, the coder known to have an adverse effect on a coded speech signal; and correct the coded speech signal as a function of components introduced into the coded speech signal due to the rate reduction.

* * * * *